US007126291B2

(12) United States Patent
Kruse et al.

(10) Patent No.: US 7,126,291 B2
(45) Date of Patent: Oct. 24, 2006

(54) RADIO FREQUENCY LIGHTING CONTROL SYSTEM PROGRAMMING DEVICE AND METHOD

(75) Inventors: Glen Andrew Kruse, Lansdale, PA (US); Jason Douglass Craze, Allentown, PA (US); Robert Francis Walko, Jr., Macungie, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 293 days.

(21) Appl. No.: 10/704,521

(22) Filed: Nov. 6, 2003

(65) Prior Publication Data

US 2005/0102040 A1 May 12, 2005

(51) Int. Cl.
*H05B 37/00* (2006.01)

(52) U.S. Cl. ..... 315/316; 315/312; 700/3; 700/9; 340/3.5

(58) Field of Classification Search ..... 315/291, 315/292, 294, 312, 316; 700/3, 9, 11, 20; 340/825.22, 825.52, 3.5–3.55
See application file for complete search history.

(56) References Cited

U.S. PATENT DOCUMENTS

| | | | | |
|---|---|---|---|---|
| 5,838,226 | A | 11/1998 | Houggy et al. | 340/310.11 |
| 5,848,054 | A | 12/1998 | Mosebrook et al. | 340/3.7 |
| 5,905,442 | A | 5/1999 | Mosebrook et al. | 340/3.7 |
| 5,982,103 | A | 11/1999 | Mosebrook et al. | 315/312 |
| 6,823,223 | B1 * | 11/2004 | Gonzales et al. | 700/20 |
| 6,831,569 | B1 * | 12/2004 | Wang et al. | 340/825.52 |
| 6,859,644 | B1 * | 2/2005 | Wang | 315/312 |
| 2005/0001557 | A1 | 1/2005 | Walko | 315/149 |

* cited by examiner

*Primary Examiner*—Tuyet Vo
*Assistant Examiner*—Ephrem Alemu
(74) *Attorney, Agent, or Firm*—Ostrolenk, Faber, Gerb & Soffen, LLP

(57) ABSTRACT

An independent radio frequency programming device automates a setup process for a lighting system with lighting control devices and master controls. The programming device intercepts communications between the lighting control devices and the master control during an initial setup phase. A start function permits the programming device to provide automated setup information to the master controls. Once the automated setup process completes, the lighting system is fully programmed with behavior functions for all lighting control devices.

18 Claims, 6 Drawing Sheets

RADIO FREQUENCY LIGHTING CONTROL SYSTEM PROGRAMMING DEVICE AND METHOD

BACKGROUND OF THE INVENTION

1. Field of the Invention

The present application relates generally to a device for programming a lighting system, and relates more specifically to a device for automatically setting up a lighting preference for an automated programmable lighting system.

2. Description of the Related Art

Lighting systems that use radio frequency (RF) signals to communicate with lighting controls are well known. For example, a radio frequency lighting control system is described in U.S. Pat. Nos. 5,848,054, 5,838,226 and 5,905,442. Those patents describe a central system for controlling electrical devices such as electric lamps in a building structure from remote locations through, e.g., radio frequency links.

In those patents, a system for controlling the status of electrical device, for example, electric lamps, from a remote location via communication links such as radio frequency links, power line carrier links or infrared links, is described. The described system includes a plurality of lighting control devices such as switches and dimmers. Also included is a master control, for controlling the status, such as on, off and dimmed, of electrical devices such as lamps. A master control has a plurality of actuators for actuating various ones of the electrical load devices and transmits information to the lighting control devices for controlling the electrical loads via radio frequency links. The various lighting control devices transmit status information back to the master control concerning the status of the controlled device (e.g., lamp) that is on, off or at a set dimming level. Some control devices may not receive the information transmitted by the master control, and the master control may not receive information transmitted by the control devices, due to, e.g., interference, weak signal, poor location, etc. Accordingly, a repeater or a plurality of repeaters is placed in the building structure to ensure that two-way communication between the master control and each of the control devices is achieved. Each repeater is identified as either a master control or a normal repeater for control and transmission purposes.

The entire disclosures of U.S. Pat. Nos. 5,848,054, 5,838,226 and 5,905,442, as well as companion patents U.S. Pat. Nos. 5,905,442 and 5,982,103 are incorporated herein by reference. U.S. Pat. No. 5,848,054 describes the process of installing various devices so that they are recognized by the master control and able to communicate with the master control to achieve control of the connected lighting devices. Other programmable lighting control systems are described in U.S. patent application Ser. No. 10/681,062, filed on Oct. 8, 2003, now U.S. Pat. No. 6,927,547 the entire disclosure of which is hereby incorporated by reference. In that patent application, subnets are described that include programmable lighting devices that communicate with each other to realize a large-scale lighting control system. The subnets organize the devices into groups for ease of setup and simplified communication organization.

The prior art programmable lighting systems described in the above referenced patents and application have a manual setup in which each installed device is physically identified to a master control in a manual programming setup. A user places the lighting system in a programming mode and then operates each of the lighting control devices to obtain the physical identification to a master control. Accordingly, the user physically goes to the location of the lighting control devices and manually operates each to assign them to the master control. The lighting system is then placed in another programming mode and the user selects a button to program and again physically goes to each lighting control device and sets each in a state, or level, to be associated with the programmed button. This programming process is then repeated for each button until all desired buttons are programmed with a desired lighting condition for a button actuation. Although this setup operation works well for setting desired lighting conditions in response to button press events in the lighting system, it can be time consuming.

It would be desirable to automate the addressing and programming process to avoid the manual setup of each lighting device with the lighting control system.

SUMMARY OF THE INVENTION

An automated setup device provides RF setup instructions to devices in a wireless lighting system. The setup, or programming device, can be portable, handheld, or more permanent in use and maintained with the system being programmed, for example. The programming device programs and operates devices in the lighting system to set up a central wireless home lighting system, for example. In the lighting system, one or more devices are available for programming to obtain automated setup of the control for the lighting devices.

The programming device simplifies the installation process of a lighting control system configuration. In one embodiment, the lighting control system comprises several master controls including a multifunction entry master control (MFE) and a tabletop master control (TT), as well as a plurality of dimming controls and a repeater device. However, the present invention is not limited to this specific embodiment and other configurations are contemplated within the scope of the invention. For example, a single master control can be used in place of the several master controls and repeaters for a given application. A single dimming control or switch may be used in the system as well. For the purposes of illustration, the following discussion provides the details of an exemplary implementation, in which the lighting system includes two master controls, a repeater and a plurality of dimmers that control various lighting or lamp loads. It should be apparent, however, that other implementations are readily achieved under the scope of the invention described herein.

The programming device operates by communicating with lighting control devices in the lighting control system according to particular conventions that can depend upon the context of the system state. For example, in one context, the programming device listens to message traffic between the repeater and the other devices comprising the system during the device activation phase of the system setup process. Device activation occurs when a repeater is placed in addressing mode, and the master controls and lighting control devices are activated to be identified and obtain an associated address in the system. The programmer captures each of the device addresses as they are assigned to their respective units, and using this information plus its own internally stored default parameters, then completes the installation process by assigning to each of the devices their necessary button assignments. Likewise, the master controls are programmed with the corresponding information regarding the dimmers.

In another context, the programming device may simply change a setting in one or more devices in the lighting system, for example to enable or disable a particular function. In a further context, the programming device may be used to reprogram a previously setup lighting control system. Reprogramming will take longer because the current programming is not known and therefore all information regarding the system setup must be programmed. When the system has just been set up and the devices are in a default programming state, the programming can be abbreviated to only program information that is different from the default state. According to a feature of the present invention, the lighting control system can be queried to determine device setup, and devices to be programmed are identified. The identification of devices to be programmed reduces the overall programming task and saves programming time.

According to an embodiment of the present invention, the programming device includes software and an RF transceiver for implementing a communication scheme for programming the wireless lighting system. The communication scheme includes eavesdropping on the message traffic between the repeater and other lighting control devices during setup. The communication scheme also includes a protocol for identifying the devices for communication and handling communication interchanges.

According to another embodiment of the present invention, the lighting control system devices communicate in a specified medium, such as power wiring, fiber optics, radio waves and infra red signaling. The programming device is adapted to the specified medium to automate the programming process without departing from the inventive subject matter and invention scope.

According to another embodiment of the present invention there is provided a programming device for a radio frequency lighting control system. The radio frequency lighting control system comprises a master control with a plurality of actuators for controlling a plurality of lighting control devices. The plurality of lighting control devices controlling the lighting loads, with each of the control devices having a transmitter/receiver for communicating with another system component. The master control communicates with the lighting control devices to provide control signaling for operation of the components of the lighting control system. A repeater retransmits, or repeats, information communicated between the master control and the lighting control devices to improve the signaling range of the lighting control system.

According to one embodiment, the repeater includes a feature for originating communications with the lighting control devices, such as in the case of initial device address assignment, for example. In a typical application, however, the repeater simply echoes commands among the components provided in the system.

According to another embodiment, the programming device comprises a transmitter/receiver communicating with the master control and lighting control devices, and a processor communicating with the transmitter/receiver. In one context of the present invention, the programming device queries the master control to determine the type of master control and then programs the master control.

According to another embodiment, the programming device also programs each of the plurality of lighting control devices and verifies a state of the lighting control device programming by impersonating a master control. The programming device can send a command to the lighting control device, to activate the device to obtain an acknowledgement. Should a lighting control device fail to respond, the programming device can make a second attempt to program the lighting control device and activate the device to obtain the expected acknowledgement. If an acknowledgement is not received, an error is annunciated and the programming device waits for further instructions.

According to a feature of the present invention, the programming device is portable and handheld. Optionally, the programming device obtains power from a battery, or through standard commercially available power. In one embodiment, a wall transformer accompanies the programming device to supply transformed power to the programming device. Alternately, the programming device may be powered directly from standard outlet power.

The programming device programs lighting systems with a minimal number of components, as well as complex large systems with a large number of components and/or a large number of subnets. According to another feature of the invention, the programming device is usable with multiple lighting systems and may be used multiple times.

In one embodiment of the present invention, the programming device writes directly to the memory of the system devices. In the case of enabling or disabling a feature, the programming device writes one value to one memory address, for example. In the case of programming devices, varying data is written to different memory addresses based on which device is being programmed and what the desired programming is. Accordingly, static information known a priori may be programmed into system devices directly. Alternately, or in addition, dynamic information is written to the device being programmed based on system configuration and desired system behavior.

According to a feature of the present invention, lighting control system setup need not be achieved by manually programming at each device location. In addition, a given individual may complete the system setup even though not present during system installation.

According to another feature of the present invention, lighting control device behavior can be changed which would not otherwise be accessible. For example, a lighting control device setting can be changed using the programming device according to the present invention that is not modifiable through direct interaction with system components. If a setting is made accidentally, for instance, the programming device can readily reset the setting to overcome problems resulting from the accidental setting.

According to another feature of the present invention, programming time and complexity is reduced. Because devices are placed in a known condition, only programming changes need be made, rather than a complete system reprogramming. Without knowing the state of the devices, the complete reprogramming would be needed, taking 2 to 3 times longer than the programming changes alone. The known condition occurs when the devices are activated into the system. The activation process is provided to give addresses to the devices, thereby establishing a known condition, without adding to the overall system setup time.

According to another feature of the present invention, the number of repeaters in the system is determined. This determination permits communications to be optimized. The repeaters may also be queried to find out how many master controls are in the system. This information permits a determination during programming for tracking the master controls that were awake and were programmed. Once programming is complete, missing master controls can be identified and indicated to a user. For instance, if a battery powered (cordless) master control was asleep during the programming process, it would be identified through the query procedure. Without this option, all known master controls capable of communicating would be programmed, but no indication of missing master controls would be obtained. Also, by querying for devices in the system, it is possible to identify the devices that need to be programmed, rather than simply programming all devices, thereby saving on programming time.

According to another feature, the programming device can query a device to be programmed to ensure it is awake and operating properly to avoid wasted time in attempting to program devices that are not responsive.

According to an embodiment of the present invention, a device setting is modified by: pressing and holding a programmer power button until the corresponding LED turns on; pressing and holding a disable button until the corresponding LED turns on; pressing and holding an activate controls button on a repeater until the corresponding LED turns on; pressing a start button, which is optionally flashing; waiting for a done LED to turn on; waking up a battery powered (cordless) master control if an error LED and a done LED turn on; waiting for a start LED to begin flashing before waking up another battery powered (cordless) master control; and pressing and holding a power button until a corresponding LED turns off.

BRIEF DESCRIPTION OF THE DRAWINGS

The present invention is described in greater detail below, with reference to the accompanying drawings, in which.

DETAILED DESCRIPTION OF THE PREFERRED EMBODIMENTS

The device and method according to the present invention uses RF communications through an eavesdropping function to prepare programming setup for a distributed control system. Although the present invention describes specific embodiments that include a wireless communication configuration for a lighting control system, any type of control system in which communication between devices takes place should be considered to be within the scope of the invention. For example, the present invention may be used with control systems that communicate through hard wired connections, fiber optic cables, infra red and so forth. In the case of hard-wired communication, the communication pathway may be a power-wiring network, for example. In addition, the present invention is not limited to lighting control systems, but is also applicable to security systems, HVAC controls, or any programmable control system in which the components are able to communicate. Any of these systems may use wireless or other types of communication, as discussed above.

Figure 1:
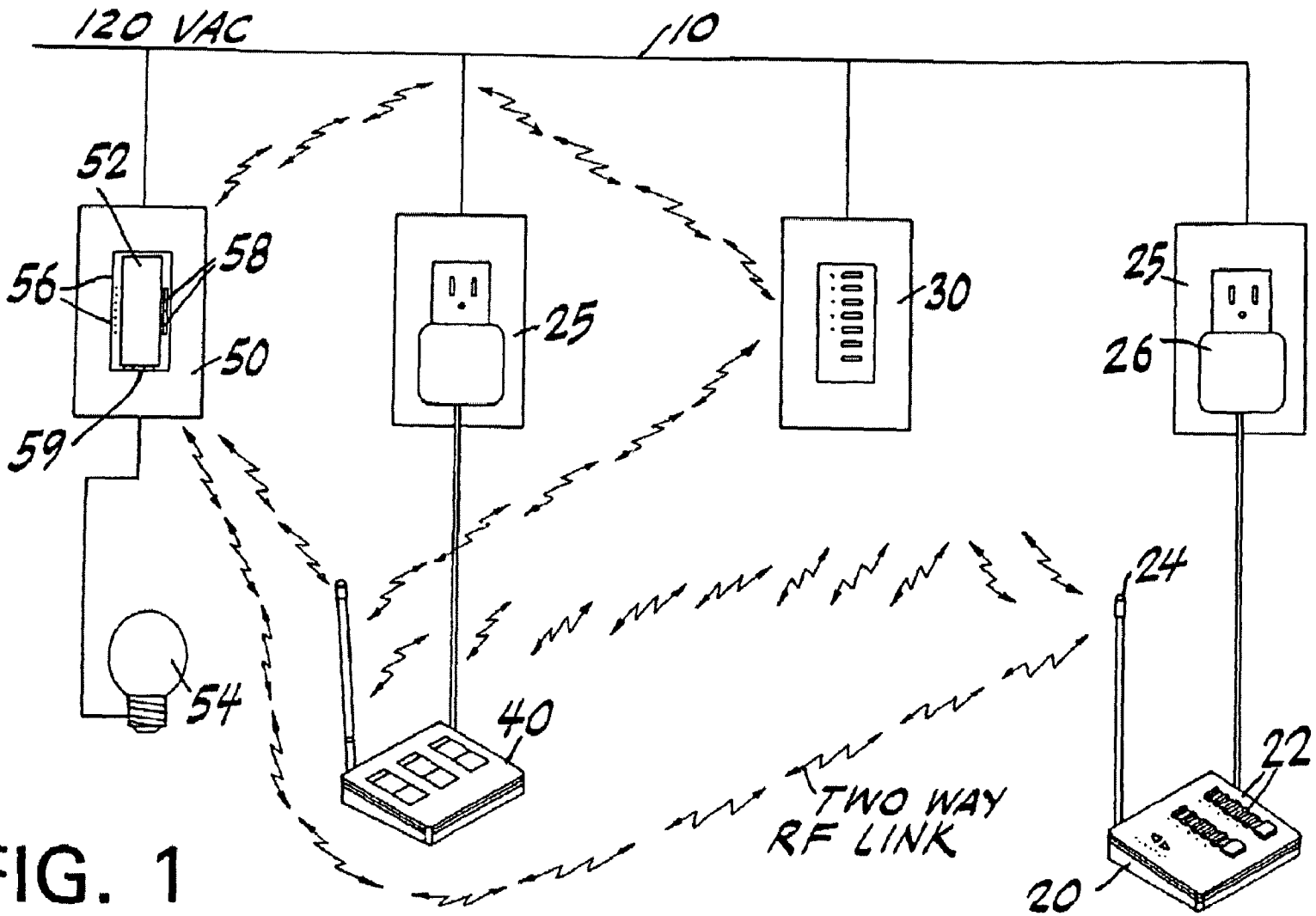
FIG. 1 is a diagram of interaction for components of the prior wireless lighting control system.

An exemplary embodiment of the invention will be understood with reference to the prior wireless lighting control system described in FIG. 1. The system shown in FIG. 1 illustrates one embodiment of a wireless lighting control system to which the present invention may be applied. However, it should be apparent that the present invention may be used with other prior lighting control systems, and with new lighting control systems that have, for example, features that are advantageous with the programming device according to the present invention. For example, while FIG. 1 shows various master controls and repeaters in a prior lighting control system, the programming device of the present invention does not require such a configuration to perform its function. Other configurations that include a single master control, no repeaters, or fewer components are considered to be within the scope of the invention, for example. The present invention is also not limited to a wireless control system, but may be used with control systems that use other communication mediums.

Referring now to FIG. 1, the exemplary prior lighting control system has two master controls 20, 30. Master control 20 is a multi-function entry (MFE) master control for executing a number of functions with buttons 22. For example, master control 20 can operate external devices including garage door openers, security systems and the like through hard wire connections, for example. Master control 20 may also control lighting levels throughout a building and its surroundings through RF communication with wireless lighting controls, for example. Master control 30 is illustrated as a wall mounted device, but need not take such a form. For example, master control 30 can be a tabletop (TT) device resembling master control 20, and include lighting scene selection buttons, dimming selection and level setting. A repeater 40 is a secondary wireless control that repeats communications between components in the wireless lighting control system. Master controls 20, 30 contribute to operating the lighting system by providing programmed instructions to light control device 50, in response to button press events, for example.

When a new lighting control system like the system shown in FIG. 1 is to be set up, master controls 20, 30 and lighting control devices are introduced into the system one by one. As the components are recognized by the system, they are given appropriate designations and control addresses. In the case of a system that is already set up, where new devices are added, for example, a reintroduction of the existing devices is not needed.

Once all components are identified, master controls 20, 30 and lighting control device 50 are ready to be programmed. Once programmed, master controls 20, 30 can provide signals to lighting control device 50 in response to button press events at master controls 20, 30, for example. Repeater 40 assists in this process by relaying signals in the system to assist in ensuring signal quality, for example. The actions of lighting control device 50 in response to a button press event are preferably stored in non-volatile memory such as EEPROM so that programming remains stored in the programmed device even if power to the system is lost.

In the prior system illustrated in FIG. 1, a programming configuration is achieved manually by having a person operate each lighting control device during addressing mode for identification and to obtain an address. The person is further called upon during program mode to set lighting conditions such as on, off and dimming levels for each button that is programmed, and for each lighting control device 50. Accordingly, the person must visit each lighting control device 50 every time a button is programmed. With a number of buttons to program, the time to accomplish the programming task, i.e., visiting each lighting control device 50 for each button programmed, can become inconveniently large.

The present invention achieves a programmed lighting system automatically with a programmer that operates to set up a lighting control system. For example, it is contemplated that the programming device will be used with a standard setup kit to create a standardized initial setup to avoid the time and effort otherwise required in the manually programmed system.

Figure 2:
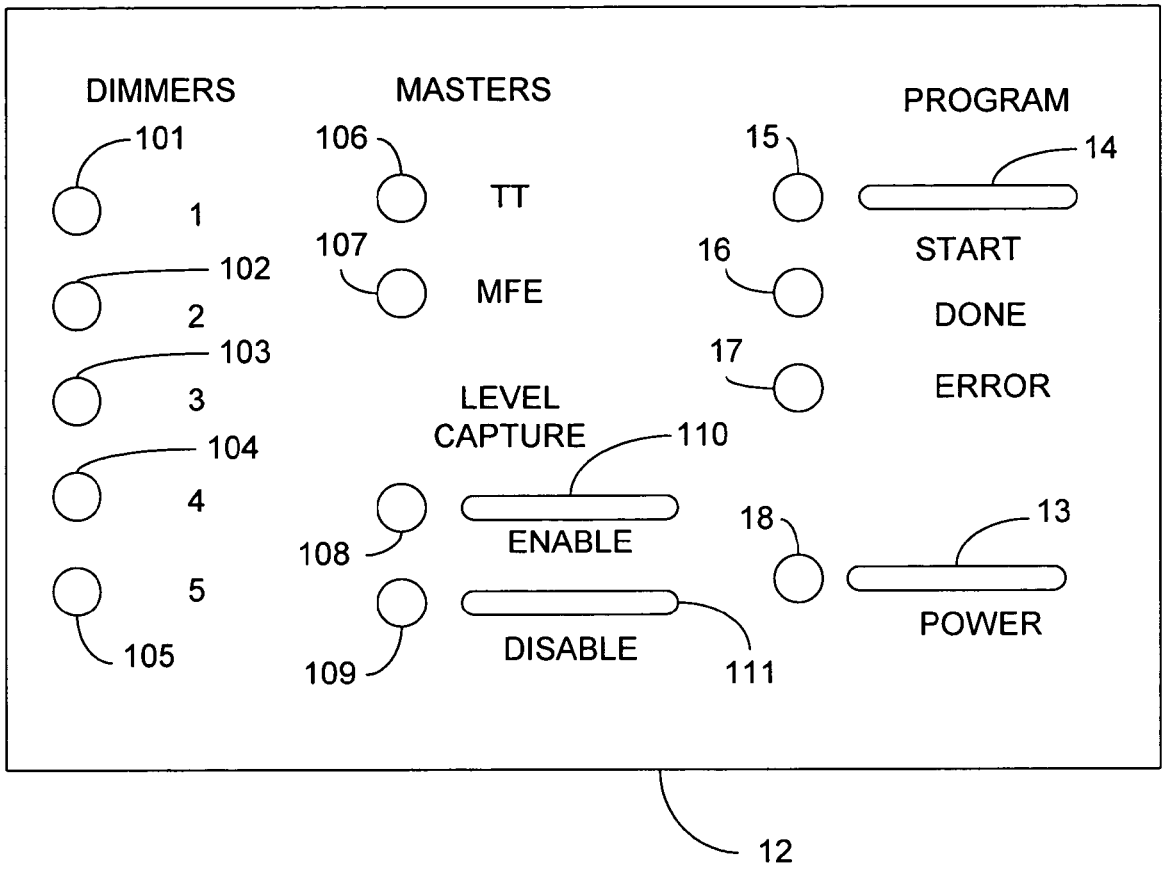
FIG. 2 is an illustration of an embodiment of a programming device according to the present invention.

Referring now to FIG. 2, an illustration of a programming device 12 is illustrated. Although programming device 12 is shown as a portable, battery operated handheld device, it need not be used in this form. For example, programming device 12 may be in the form of a wall or table mounted device that obtains power from standardly available residential or commercial power as an alternate or in addition to battery power. Programming device 12 can alternately or optionally have selection criteria available, such as buttons or displays for selecting programming features. Programming device 12 may also be connected to a network, such as the Internet, or other suitable devices, and have programming updates made available to it and the lighting control system on a regular or automatic basis. The embodiment described herein is provided to illustrate the basic features and options for programming device 12, but the invention should not be considered to be so limited, as other embodiments are easily realized with the same fundamental features and operations, as described above.

Programming device 12 has a power button 13 for turning on the device when powered by a battery. A start button 14 provides several functions, including a means for beginning and restarting the automated programming process. LEDs 15–18 give programming and system status information for the lighting control system before, during and after programming. LEDs 101–107 provide indicia of signaling events during setup of the lighting control system. For example, LEDs 101–105 illuminate when lighting control devices 50 in the form of light dimmers, for example, are activated in the lighting control system. LED 101 lights when a first dimmer is activated, for example, while LED 102 illuminates when a second dimmer is activated. The same is true for LEDs 106 and 107 for activation of TT master control 30 and MFE master control 20, respectively. LEDs 108 and 109 are optionally provided with optional enable button 110 and disable button 111, respectively. The level capture feature provided in lighting control device 50 permits a user to set a default lighting level, which is occasionally accidentally set to an inappropriately low level. In such a situation, the user activating the dimmer does not see and lighting turn on, since the lighting default level is set so low. The level capture feature may be turned off to prevent this type of situation The enable and disable functions for level capture serves to modify settings in master controls 20, 30 to enable or disable level capture. Once the enable or disable function is realized, programming device 12 can force a reset in the system, for example.

The lighting control system can be queried for status and reprogrammed with settings in accordance with the above description when disable button 111 is pressed and held for a short period of time according to an exemplary embodiment. Disable LED 109 illuminates when the level capture disable feature is active, and enable LED 108 illuminates when the level capture enable feature is active.

Figure 2A:
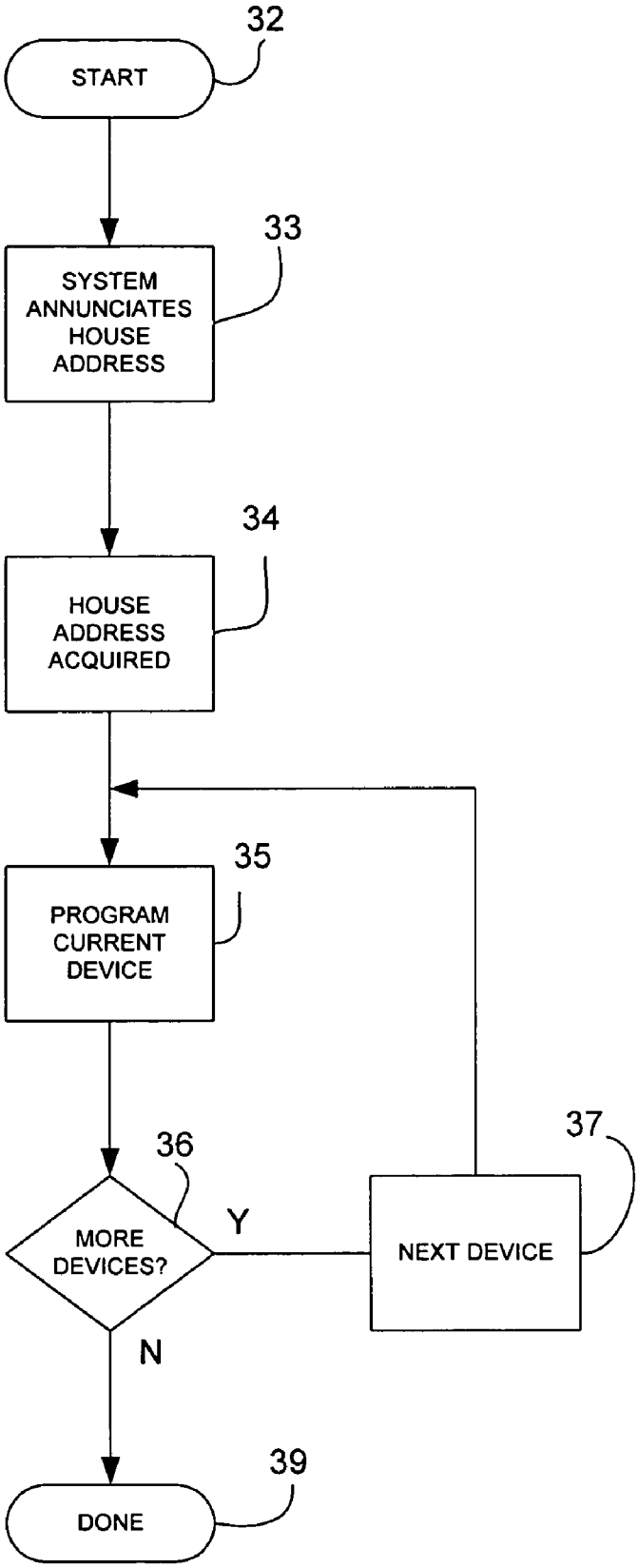
FIG. 2A is a flowchart showing overall programming operation according to the present invention.
Figure 2B:
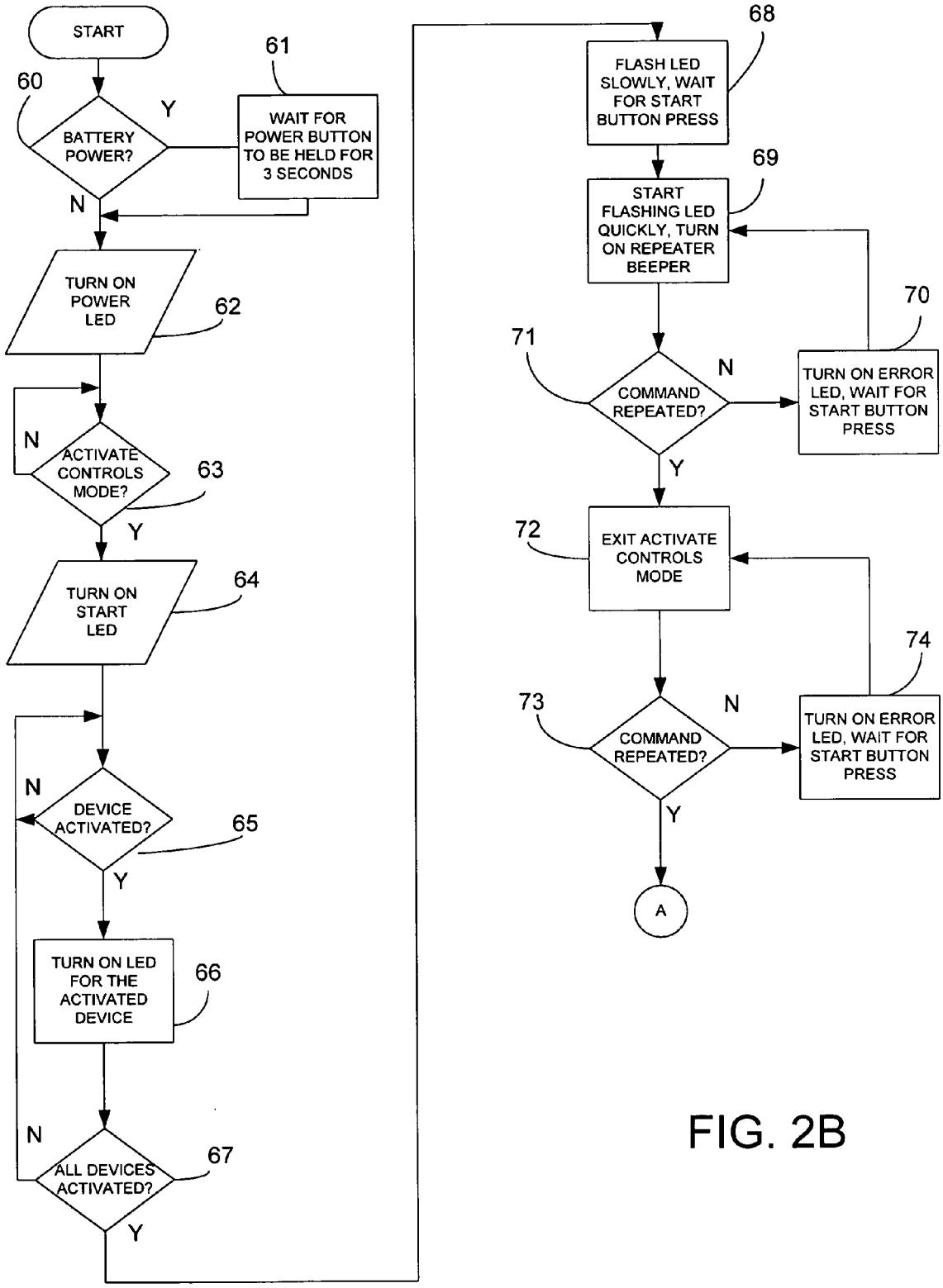
FIGS. 2B, 2C and 2D are flowcharts illustrating the operation of the programming device according to the present invention.

Referring now to FIG. 2A, a flowchart summarizing the overall operation of the present invention is illustrated. In step 33, the control system is prompted to send its system address to identify it separately from other nearby or interconnected systems. Once the system address is acquired in step 33, programming device 12 can ensure that other systems that may be available are not involved in a programming process. For example, a control system may communicate among devices through a power-wiring network. If several control systems are connected to the network, programming of one system will cause erroneous settings in other systems. By using a system address, this problem is avoided.

In step 34 a system component is selected for programming and sent commands for that purpose. The device is completely programmed and programming device 12 determines if any devices remain to be programmed in decision step 36. If additional devices are to be programmed, a next device is selected in step 37, and the process continues until all devices are programmed.

Referring now to FIG. 2A, a flow chart illustrating an exemplary operation of programming device 12 is provided. This flow chart represents a specific embodiment of the operation of the present invention, and should not be considered to be limiting for the scope of the invention. For example, although certain conventions are observed for operating programming device 12 in given configuration environments described below, the invention can be flexibly used to program system components according to different flows or conventions. Programming device 12, as well as the system to be programmed, may change in hardware or software configuration and continue to achieve the goal of automating the programming process for the lighting control system components Programming device 12 can run off of standard outlet supply power, such as provided in residential housing, or can operate independently off a battery, for example. Programming device 12 can be provided with a wall transformer for transforming outlet power to a more readily usable and appropriate power, for example. In addition, programming device 12 may be designed to include direct power reception from outlet power. If powered by a battery, as determined in step 60, programming device 12 is turned on by holding down power button 13 for approximately 3 seconds as shown in step 61. The delay is provided to prevent unwanted or accidental activation, for example.

When turned on under battery power, programming device 12 stays active for 30 seconds, for example, to listen for message traffic for system setup. The active period is provided to permit programming device 12 to save battery power and become inactive if no message traffic is identified in the active period. The same power saving convention applies if no message activity is encountered during programming, or at the end of programming. Any messaging activity refreshes the timeout period to prevent programming device 12 from becoming inactive. If a period of inactivity is encountered during programming, i.e., no message activity occurs for some reason, programming device 12 becomes inactive. Once messaging activity resumes, programming device 12 becomes active and continues with whatever process was underway prior to the inactive period. For example, once becoming active, programming device 12 continues with the programming procedure where it left off when becoming inactive.

Once power is delivered to programming device 12, power LED 18 turns on to indicate power is on in step 62. Programming device 12 immediately begins eavesdropping on communication traffic in the lighting control system. In one context or exemplary operation at this point, a programming procedure commences if devices are already activated in the system. The activate controls mode is initiated at repeater 40, which is picked up by programming device 12, and programming begins. This particular context is possible when the state of the system is known, i.e., the devices are activated into the system a priori.

In the situation in which the state of the system is not known, programming information is sent to the devices to establish a known state. In an exemplary implementation, a normal activation sequence puts the system devices in a known state that allows, for example, only information that is different from a default state to be programmed. A priori knowledge that the devices are in the default state can make the programming procedure 2 to 3 times faster. In an exemplary system, the activation process is part of the system setup and therefore no additional steps are being performed by the user.

In an exemplary initial system setup, repeater 40 is activated and initialized while programming device 12 is listening. Repeater 40 is activated by pressing and holding a main button, and then initialized by pressing and holding an activate-repeater button, for example. Repeater 40 enters control activation mode with the press and hold of an activate-controls button in step 63, for example, at which point the programming process can begin. It should be apparent that any type of activation process may be used with the present invention, as long as programming device 12 can listen to messaging traffic. The repeater activation, initialization and entering control activation mode are substantially similar to the prior system.

Once repeater 40 is in control activation mode, a user begins the process of setting up switches and buttons manually to provide the manual programming to repeater 40. In the present exemplary embodiment of the invention, repeater 40 entering control activation mode provides an initial signal for programming device 12 to understand and indicate that it has found a system to listen to. For example, programming device 12 illuminates start LED 15 to indicate a system to listen to has been found. Other embodiments of programming device 12 may have other indicia for indicating a system to listen to has been found, such as audible tones, displays such as in a user interface or an LCD screen and so forth. For example, it should be apparent that while programming device 12 can be a custom made device, it can also be implemented in a PC, a PDA, mobile phone or the like, with all the available features, including displays and indicators, of those devices usable in programming a lighting control system.

Once repeater 40 enters activate controls mode in step 63, an indicator in programming device 12, such as start LED 15, is turned on and the lighting control system is ready for control setup. During control setup, each device in the system is manually activated to register the device with the system. Registration occurs with repeater 40 building a memory structure for each device that is activated and read by repeater 40. Repeater 40 communicates with the activated device and reserving an appropriate block of memory at a specified address. The dimmers and master controls are each activated in turn as examples of control devices, and are verified for RF communication, for example, in step 65. As repeater 40 assigns addresses to each activated device, a number that is unique to each activated device in the local setup is also assigned. The address and device number setup are echoed in listening programming device 12, to permit a later automatic programming operation. That is, programming device 12 is aware of the memory structure, addresses and device numbers available in repeater 40, and will use these criteria for automating the setup process after all devices are registered.

In an exemplary feature of the present invention, each activated device has a corresponding LED turned on in programming device 12 as it is activated in step 65. The process is repeated for each device, including master controls 20, 30 and lighting control devices 50, which can include dimmers and other lighting controls, for example. Once all devices are activated in step 67, start LED 15 on programming device 12 begins to flash slowly in step 68. The slow flash indicates a ready or standby mode awaiting a signal from start button 14 to begin the automated programming process. If programming device 12 becomes inactive during this period because of the battery power saving timeout feature, programming is resumed by pressing start button 14. It is also possible to abandon system programming using programming device 12 by pressing and holding start button 14, preferably for 3 seconds, for example. If start button 14 is pressed during the programming operation, an error occurs and error LED 17 turns on and programming ceases. Pressing start button 14 again recommences the programming phase. In a preferred operational setup, a normal activation process is complete prior to pressing start button 14 to commence the programming operation. In another context or exemplary operational setup, if the system had been previously activated so that system devices are already activated into the system, the programming operation would begin at this point.

Once start button 14 is pressed, programming device 12 begins to flash start LED 15 at a rapid pace in step 69 to indicate programming is taking place. Programming device 12 turns on a beeping function in repeater 40 to indicate communication activity taking place between the various system components. The beeping function is optional to alert a user or other system that programming is occurring, and serves to satisfy regulatory requirements for wireless communications, for example. It should be apparent that the beeping function is not necessary to realize the present invention.

In step 71, a check for a repeated command is made to ensure all devices in the system were able to respond and correctly repeat the communication. If the communication was not repeated properly, an error LED 17 is turned on, and the system waits for interaction with the user, indicated by a start button press in step 70. This waiting period, among other options, permits a user to reconfigure the system to ensure good communication, or identify malfunctioning or non-powered components. Similar to the beeping function, the repeating command function represents compliance with regulations for communications that mandate particular interaction between wireless devices in a given setup. More specifically, programming device 12 uses the repeated wireless signal command from repeater 40 to cause an automatic activation in which the programming device 12 will send another recognition code, for example. That is, the repeat mechanism can used as a signal for programming device 12 continue sending commands, similar to a confirmation. However, it should be apparent that the repeating function is not necessarily implemented to realize the invention in the application.

An optional step (not shown) may be provided for systems in which a number of repeater type devices are used. For example, in systems that cover large areas, multiple repeaters may be necessary to ensure communication is properly carried out over the entire desired area. In this scenario, an optional step can be provided to query the repeater for the number of repeaters in the system. A query command would be subject to the same repeat confirmation and error response as indicated in steps 72–74 for the exit activate controls mode, for example. If a number of repeaters are present in the system, programming device 12 takes the number into account for all further communications.

In step 72, the command has been repeated properly, and programming device 12 issues a command to exit the activate-controls mode. The command repetition and error responses are handled in steps 73 and 74, respectively, similarly with steps 71 and 70. The error response for repetition of a command, taking into account the number of repeaters, for example, is similar to that described above, and will not be repeated for the sake of brevity.

Figure 2C:
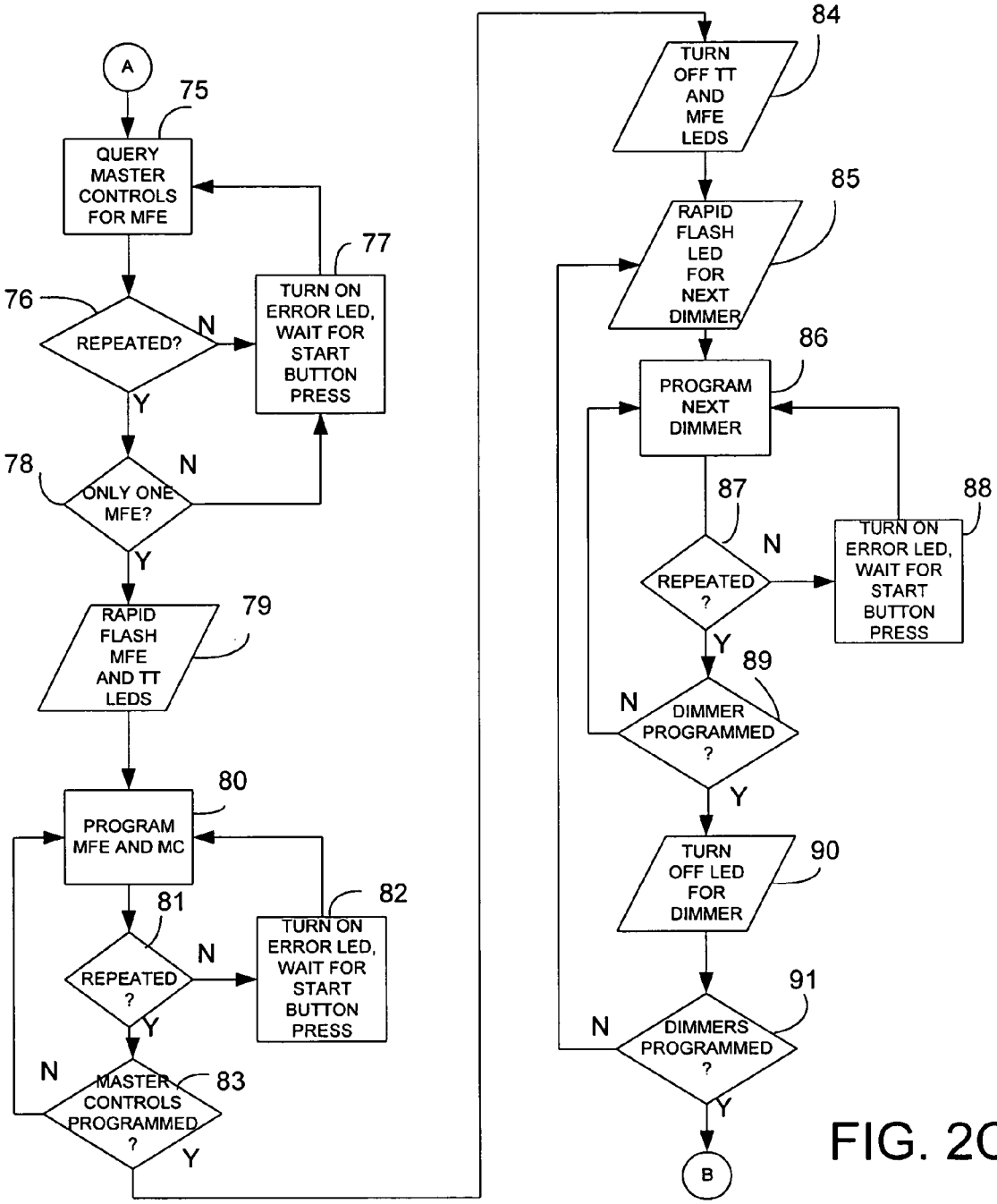

Referring now to FIG. 2C, in the exemplary embodiment, programming device 12 queries master controls 20, 30 to determine that a master control exists that is identified as an MFE. Steps 76 and 77 verify no error occurred in the command for querying the master controls. The query to master controls 20, 30 returns the result that master control 20 is identified as an MFE, for example, and a single MFE is verified in step 78. If there are more than one MFE identified, the programming does not proceed and an error is annunciated in step 77. This check ensures that no confusion between devices will occur during programming. Again, this scenario represents only one of a number of available protocols and configurations for providing a communication control system, and need not be realized to accomplish the present invention.

Preliminary to programming master controls 20, 30, LEDs on master controls 20, 30 are rapidly flashed in step 79 to indicate communication is taking place and programming is proceeding. The programming commands are provided to master controls 20, 30 in step 80, and each command is verified through a repeated command in steps 81 and 82. Master controls 20, 30 are programmed command by command until all programming for those devices is complete, indicated by the yes branch of step 83. Programming device 12 has a system configuration ready for download to master controls 20, 30 because it listened to all the configuration data passing between master controls 20, 30 and lighting control device 50. During the configuration messaging between the system components, programming device 12 obtained knowledge of the data structures used in the control system during the initial setup phase where addresses and numbers are assigned. As programming device 12 accesses a particular master control, it stores configuration data in the memory of the accessed master control, in memory addresses expected to be used by the master control in commanding lighting control device 50, for example. By setting the master control memory to the appropriate configuration, each master control will have button control settings automatically assigned. That is, instead of having to build the memory configuration data by manually accessing each lighting control device 50, and buttons on master controls 20, 30, the memory configuration is automatically implemented through the programming operation of programming device 12. It should be apparent that this type of programming can be used in multiple component configurations in a control system, and that the present invention is not limited to the specific embodiments described above. That is, control systems that have components capable of storing data that can be modified by a programming device such as programming device 12 can be configured according to the technique of the present invention.

Once master controls 20, 30 are programmed, the LEDs indicating the programming function are turned off in step 84. Programming device 12 proceeds with programming lighting control devices 50, which are typically light dimming control devices. With respect to either master controls 20, 30 or lighting control devices 50, the system components may be programmed to have individual personalities, or responses to system control commands. In step 85, an initial lighting control device 50 is selected for programming based on the configuration information in programming device 12. An indication is optionally provided at the selected dimmer, such as an LED that is rapidly flashed to indicate programming operations are under way, for example. The selected dimmer is programmed to have a memory configuration reflecting a setup according to the button assignments, addresses and identifier information related to the dimmer, as determined by programming device 12 during the listening phase of the setup operation. As with master controls 20, 30, the memory configuration of the selected dimmer is provided automatically by programming device 12, rather than being constructed from manual operations involving operation of master control buttons and lighting control devices. The programming commands are checked for errors by verifying repeated commands in steps 87 and 88 as described previously. Once the selected dimmer or lighting control device 50 is completely programmed, the associated LED is turned off in step 90, and a new lighting control device 50 is selected for programming. Once again, it should be apparent that the present invention does not depend on lighting dimmers as components to realize the invention, but rather can use any programmable device to obtain automation in the programming or setup process. Once all dimmers are programmed, as determined in step 91, the configuration process begins a verification phase.

Figure 2D:
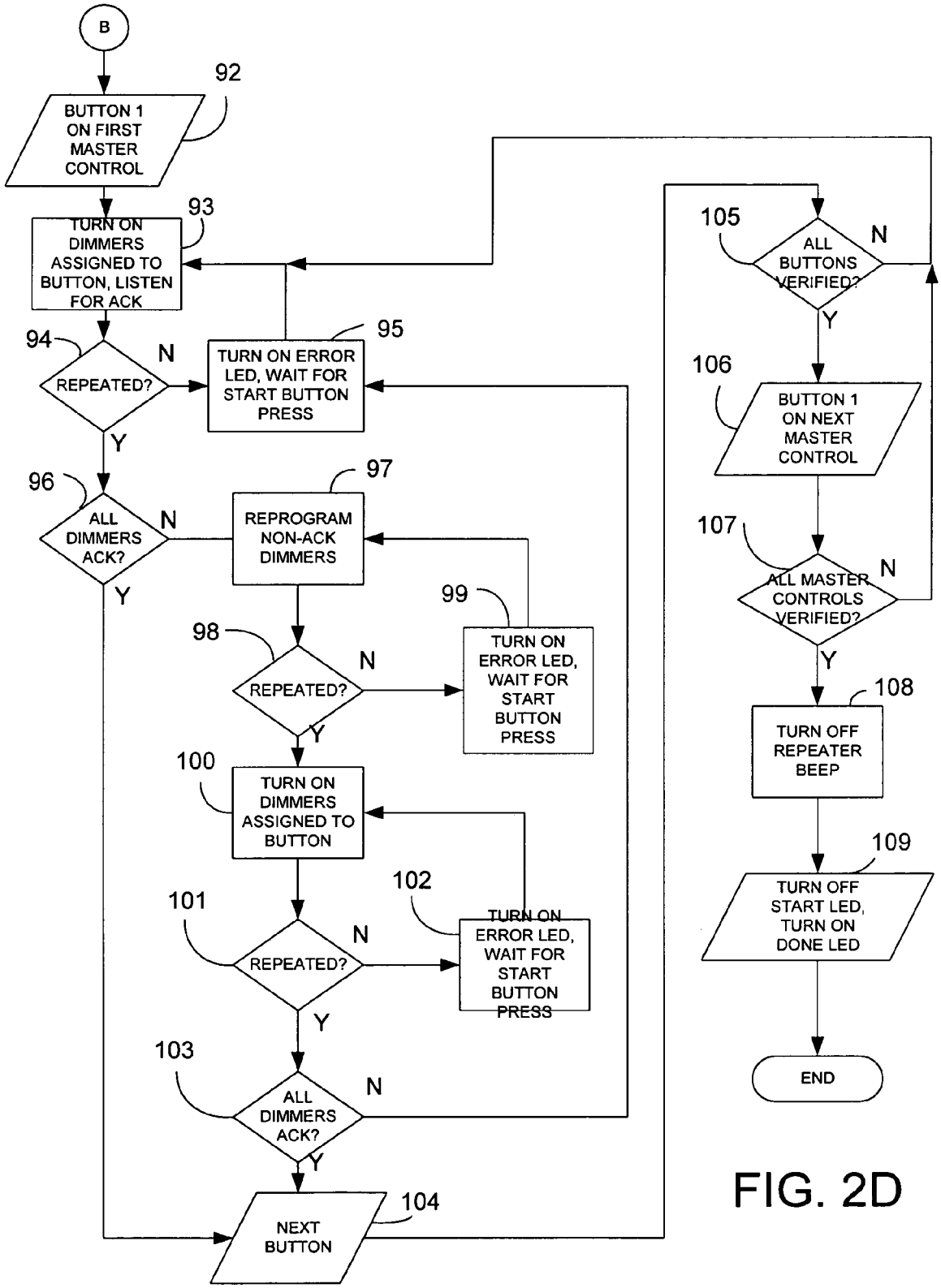

Referring now to FIG. 2D, in an exemplary embodiment according to the present invention, programming device 12 preferably begins to verify the programming of the buttons in master controls 20, 30 and lighting control devices 50. In step 92, programming device 12 selects a master control for verification, and selects a first button on the selected master control to test. Programming device 12 then impersonates the selected master control by sending in step 93 control messages that would normally originate from the master control when the selected button is pressed. The appropriate dimmers or lighting control devices 50 respond to the control messages by providing acknowledgements that would normally be received and processed by the selected master control, but are instead handled by programming device 12. As with other commands verified above, error checking is achieved in steps 94 and 95.

In step 96, programming device 12 verifies whether all appropriate dimmers have properly acknowledged the control messages in accordance with the memory configuration in programming device 12. If all dimmers provide proper acknowledgement, another button in the selected master control is chosen for verification in step 104. If a problem occurs or all dimmers do not provide appropriate acknowledgement, programming device 12 attempts to reprogram the non-acknowledging dimmers in step 97. These programming commands are verified for errors in steps 98 and 99, as described previously.

Once programming device 12 has reprogrammed the non-acknowledging dimmer, another attempt to emulate a button press on the selected master control is made by trying to turn on all dimmers assigned to the selected button in step 100, for example. Again, the command is verified in steps 101 and 102 as described previously. If all dimmers now provide acknowledgement as appropriate in step 103, verification for the selected button programming and dimmer response is complete and another button on the master control is selected for verification in step 104. If there is still a lack of acknowledgement from all appropriate dimmers, control is transferred to an error state and programming device 12 will reattempt the verification process in step 93 once the user presses start button 14. By returning to the beginning of the verification process to accept user input, programming device 12 provides an opportunity to verify component setup is proper, such as placement or connection of control devices and power being provided to all devices. Once the component setup problems, if any, are addressed, the user presses start button 14 to again initiate the verification process in step 93.

After all buttons on a selected master control are verified for operation as described above, as determined in step 105, the verification process shifts to the next available master control and a first button on the newly selected master control is chosen for verification in step 106. Step 107 determines whether all master controls have been verified, and if not, the verification process returns to step 93, in which the process for verifying operation of all buttons on the selected master control is begun. If all master controls have been verified, the verification process is complete, as well as the programming process, and programming device 12 turns off the beep function in repeater 40 in step 108. Programming device 12 then turns off start LED 15, and turns on done LED 16 to indicate programming and verification are complete. At this point, programming device 12 may be turned off, and is available for use with other systems or at other locations. In addition, programming device can be reused to reprogram an existing programmed system, in the case, for example, where further lighting control devices 50 are added to an existing system. The configuration data stored in the control devices is maintained in non-volatile memory, for example, and is not lost during a reset or power outage. Accordingly, programming device 12 is operable to send and store data that is placed in volatile or non-volatile memory, for example.

The general idea for the programming device according to the present invention is to place data in storage locations of system components of a lighting control system. The data placed in the storage locations can be data such as numbers or text, for example, or can be commands or addresses. It is contemplated that some data may be variable and can be set or reset by devices or users to operate the system in a custom or desired fashion. Data or commands can also be reset on a system wide basis, or locally, for example, through the use of settings in either the components or the programming device. The programming device may also be setup to recognize a particular control system where two or more control systems are active. For example, each control system may be assigned a unique code that is recognized by the programming device to determine which of the systems is to be programmed. The code may be stored in a repeater, for example, so that the programming device recognizes the system once the repeater is activated, as described above.

Although the invention has been described with reference to particular embodiments, it should not be considered to be so limited. Instead, the invention should be defined by the content of the following claims.

What is claimed is:

1. A method of programming a lighting control system that includes at least one master control and at least one dimmer, the method comprising the steps of:

eavesdropping with a programming device on messaging traffic between the at least one master control and the at least one dimmer to ascertain the number and types of devices in the lighting control system and to ascertain a respective unique system identifier associated with each of the devices in the lighting control system;

programming automatically with the programming device the at least one master control by storing configuration data in a memory of the at least one master control; and programming automatically with the programming device the at least one dimmer by storing a memory configuration in a memory of the at least one dimmer.

2. The method according to claim 1, further comprising repeating the steps of programming automatically the at least one master control and the at least one dimmer until each of the at least one master control and the at least one dimmer are programmed.

3. The method according to claim 1, wherein the configuration data comprises button control settings.

4. The method according to claim 1, wherein the memory configuration comprises a setup according to button assignments, addresses, and identifier information related to the at least one dimmer.

5. The method according to claim 1, wherein the steps of programming the at least one master control and programming the at least one dimmer occur during an initial setup process of the at least one master control and the at least one dimmer.

6. The method according to claim 1, wherein the programming device operates as a wireless device.

7. The method according to claim 1, wherein the programming device is a handheld device.

8. The method according to claim 1, wherein the programming device is operable to communicate via a plurality of communication links.

9. The method according to claim 8, further wherein the plurality of communication links include a radio frequency link, a power line carrier link, a fiber optic link, and an infrared link.

10. A programmable lighting control system that includes at least one master control and at least one dimmer, the system comprising:

a programming device operable to eavesdrop on messaging traffic between the at least one master control and the at least one dimmer to ascertain the number and types of devices in the lighting control system and to ascertain a respective unique system identifier associated with each of the devices in the lighting control system;

a programming circuit coupled to the programming device operable to program automatically the at least one master control by storing configuration data in a memory of the at least one master control and to program automatically the at least one dimmer by storing a memory configuration in a memory of the at least one dimmer.

11. The lighting control system according to claim 10, wherein the configuration data comprises button control settings.

12. The lighting control system according to claim 10, wherein the memory configuration comprises a setup according to button assignments, addresses, and identifier information related to the at least one dimmer.

13. The lighting control system according to claim 10, wherein the programming device is operable to program the at least one master control and the at least one dimmer during an initial setup process of the at least one master control and the at least one dimmer.

14. The lighting control system according to claim 10, wherein the programming device is operable to communicate via a plurality of communication links.

15. The lighting control system according to claim 10, wherein the programming device operates as a wireless device.

16. The lighting control system according to claim 10, wherein the programming device is a handheld device.

17. The lighting control system according to claim 10, wherein the programming device is further operable to program automatically each of the at least one master control and the at least one dimmer.

18. The lighting control system according to claim 17, wherein the plurality of communication links include a radio frequency link, a power line carrier link, a fiber optic link, and an infrared link.

* * * * *

UNITED STATES PATENT AND TRADEMARK OFFICE

CERTIFICATE OF CORRECTION

PATENT NO. : 7,126,291 B2
APPLICATION NO. : 10/704521
DATED : October 24, 2006
INVENTOR(S) : Kruse et al.

It is certified that error appears in the above-identified patent and that said Letters Patent is hereby corrected as shown below:

Column 7, line 66, change “33” to --34--.

Column 8, line 7, change “34” to --35--.

Column 8, line 14, change “2A” to --2B--.

Claim 18, line 1 (column 14, line 62) change to “17” to --14--.

Signed and Sealed this

Tenth Day of April, 2007

JON W. DUDAS
*Director of the United States Patent and Trademark Office*